US012397879B1

(12) United States Patent
Scaringe

(10) Patent No.: US 12,397,879 B1
(45) Date of Patent: Aug. 26, 2025

(54) KEEL DRIVE ASSEMBLY FOR PROPELLING AND MANEUVERING A BOAT

(71) Applicant: Mainstream Engineering Corporation, Rockledge, FL (US)

(72) Inventor: Robert P. Scaringe, Indialantic, FL (US)

(73) Assignee: Mainstream Engineering Corporation, Rockledge, FL (US)

( * ) Notice: Subject to any disclaimer, the term of this patent is extended or adjusted under 35 U.S.C. 154(b) by 450 days.

(21) Appl. No.: 18/162,766

(22) Filed: Feb. 1, 2023

(51) Int. Cl.

| | |
|---|---|
| ***B63B 1/30*** | (2006.01) |
| ***B63B 1/24*** | (2020.01) |
| ***B63H 21/17*** | (2006.01) |
| ***B63H 21/21*** | (2006.01) |
| ***B63H 21/30*** | (2006.01) |
| ***B63H 21/38*** | (2006.01) |

(52) U.S. Cl.
CPC ..... *B63B 1/30* (2013.01); *B63B 1/246* (2013.01); *B63H 21/17* (2013.01); *B63H 21/21* (2013.01); *B63H 21/30* (2013.01); *B63H 21/38* (2013.01)

(58) Field of Classification Search
CPC ..... B63B 1/30; B63B 1/246; B63H 21/17; B63H 21/21; B63H 21/30; B63H 21/38
See application file for complete search history.

(56) References Cited

U.S. PATENT DOCUMENTS

| | | | | |
|---|---|---|---|---|
| 3,238,911 | A | 3/1966 | Pazulski | |
| 3,411,013 | A | 11/1968 | Vogelsang | |
| 4,102,291 | A | 7/1978 | Sebald | |
| 6,273,015 | B1 | 8/2001 | Motsenbocker et al. | |
| 10,946,939 | B1 * | 3/2021 | Montague | B63B 32/60 |
| 2021/0371053 | A1 * | 12/2021 | Werner | B63B 32/10 |

FOREIGN PATENT DOCUMENTS

RU 211113 U1 * 5/2022

OTHER PUBLICATIONS

Translation of RU 211113-U1 (Year: 2022).*

* cited by examiner

*Primary Examiner* — Stephen P Avila
(74) *Attorney, Agent, or Firm* — Michael W. O'Neill, Esq.

(57) ABSTRACT

A unitary hermetically sealed device is disclosed for providing self-contained electric propulsion drive power to a motor boat or sailboat, where the entire propulsion system is contained in a separable pressurized hermetic enclosure attached to the underside of the vessel and also acts as a keel of the vessel, and which simplifies production, provides improved safety from high voltages, and prevents drive system maintenance or repair when the vessel is located in the water. The rigid hermetically sealed device functions as a skid-plate to avoid damage to the softer typically fiberglass hull when running the vessel aground or when running up onto or off of the beach or onto or off a trailer.

34 Claims, 3 Drawing Sheets

KEEL DRIVE ASSEMBLY FOR PROPELLING AND MANEUVERING A BOAT

BACKGROUND

The present disclosure is directed to a self-contained, pressurized, hermetically-sealed regenerative, electric propulsion and energy storage system to be directly attached to and form the bottom skid plate of the vessel's hull, and also serving as the keel of the vessel. In such a configuration, all energy storage, drive electronics and control electronics, and propulsion and steering equipment are located within this unitary assembly which is attached to the external surface undersea bottom portion of the vessel, where it can also function as the keel and skid plate of the vessel.

This self-contained assembly, hereafter referred to as the Keel Drive Assembly, or KDA, is designed so that it is accessible for repairs only when the vessel is out of the water (in drydock) and optionally, only when the KDA has been detached from the hull of the vessel. The KDA is also pressurized with an oxygen free or inert gas, or pressurized with an electrically non-conductive fluid, such as oil, refrigerants, and the like, to prevent battery fires and to use the pressure drop as an indication of a potential leak in the system. The KDA optionally also has the ability to harnessing the power of ocean currents or the movement of seawater past the KDA, either during sailing if a sailboat, or when being towed if a motor-boat, or when anchored in a current (such as tidal change) to provide regenerative power to the energy storage located within the KDA. Particularly, the present disclosure is concerned with implementations of a safe, unitary, KDA for both power boat and sailboat applications, that will allow much higher operating voltages in the range of 600 to 1,000 volts (or higher as technology emerges) thereby reducing the size, weight and cost of the power electronics, motors and electrical conductors.

The concept of providing drive power for a boat by using an electric motor with batteries to power the boat instead of a fuel-powered combustion engine is not new. Likewise using the movement of the boat via the sails to spin the propeller and recharge the batteries is also not new (U.S. Pat. No. 4,102,291, issued to Sebald, and U.S. Pat. No. 3,411,013, issued to Vogelsang). It is also understood that using the battery weigh at the lowest point in the vessel, will lower the center of gravity of the vessel, and to some extend prevent capsizing (U.S. Pat. No. 6,273,015 B1 to Motsenbocker et al.), It is generally understood in the art the concept of developing a sailboat where the auxiliary drive (used when winds are low or tight maneuvering is required) can employ an electric drive motor connected to a propeller as opposed to a fuel-powered engine or hybrid drive. The electric motor being used to rotate the propeller. It is also understood in the art, that the battery bank or other form of electrical energy storage could be recharged when the boat is at the dock with a conventional battery charging scheme, and the spinning of the one of more propulsion propellers due to the movement of the water past the one or more propellers could also be configured to charge the batteries while under sail (or for any type vessel when the vessel is at anchor if there is any current, due to a tidal change for example or when the boat is being towed, by a larger boat for example a dingy or tender to a larger boat). For the sailboat application, this recharging means can supplement or eliminate the need for auxiliary generators, solar panels, and wind turbines commonly used on sailboats.

It is also generally understood that recharging by the motion of the boat through the water (or by the water passing by the stationary boat at anchor) would spin the propeller and the drive motor acting as a generator in this situation.

It is also generally understood that the electric motor can be placed inside the hull of the boat, rotating a shaft that protrudes through the hull and is connected to a propeller. Alternatively, it is understood that a sealed motor pod can be directly immersed into the water, connected to the exterior of the hull and provides a shaft emerging from the motor pod connected to the propeller. This pod can be stationary or allowed to rotate for steering and improved mobility with the motor pod receiving electrical power from batteries stored inside the boat.

U.S. Pat. No. 3,238,911, issued to Pazulski, details an invention where the electric drive motor/generator 36 is located in the keel 20 of a sailboat along with the switching mechanism 40 (that switched operation from motor to generator), and batteries 42. These items are located in a hollow portion of the keel with a cover 22 pivotally attached to the hull by means of a hinge 24 or other pivotal means, presumably to gain access to the hollow portion of the keel (where these items are located) from within the hull of the boat. A propeller drive shaft 30 protrudes from the keel and is connected to a propeller 28.

While, all these proposed features can be implemented in a vessel, there are actually very few, if any such production electric powered boats available on the market. The electrically powered boats that are available use relative low voltages (under 150 volts) to power the propulsion motors, because of the dangers and difficulty of locating high voltage wiring within the bilge of a boat. There are many concerns with using high-voltage electric propulsions system in boats, most importantly the high voltages and therefore the risk of electrocutions and the issues of fire related to thermal run-away due to improper cooling of the propulsion batteries. My invention resolves all these issues.

It is certainly well understood that high-voltage buss, would be desirable, to reduce the necessary amperage requirements (and wire sizes) of these large horsepower motors, however, concerns about high voltages and water accessibility, flammability concerns with large battery arrays, thermal control of the batteries to prevent thermal run-away and subsequent fires, thermal control of the power electronics, and general safety have limited the use of high-voltage buss systems. When I discuss high voltages I am talking about Direct Current Battery Buss voltages well above 150 Volts DC (VDC) and Alternating Current voltages being supplied to the motor drives also above 150 VAC. Where these voltages are typically above 600 volts and, in some embodiments, above 900 volts. I have developed an invention which avoids the flammability and electrocution concerns, while also reducing cost (due to reduced current) and improves performance.

For the foregoing reasons, there is a need for a KDA system.

SUMMARY

The invention utilizes a hermetically sealed KDA enclosure that houses all the propulsion, and maneuvering drive, regenerative power scavenging, and battery recharging components including the motor, propeller, propeller shaft, power electronics, battery management and control electronics, the batteries and a cooling mechanism (rejecting the heat to the water surrounding the KDA, or the air if the boat is trailerable and being recharged while on the trailer) for all the electronics, batteries, and motor drive. By hermetically sealing the entire system, with no serviceable parts, and no access to the internals of the KDA, while the KDA is connected to the hull of the boat, the electrical buss voltage can be safely increased to reduce wire size requirements (reduce amperage requirements), and flammability issues can be avoided. This pressurized KDA is fitted with one or more thermal and/or pressure-releasing plugs (hereafter referred to simply as fusible plugs or burst disks) that will purposely open to automatically allow water to enter the KDA, in the case of a catastrophic failure of the KDA and prevent a fire. The entire KDA can also be jettisoned from the boat.

Proper thermal control of batteries is critical to avoid damage. The power electronics and motor itself must also be cooled. In my invention this thermal control is achieved by providing a conduction and/or convection heat flow pathway between the item to be cooled and the skin of the KDA to allow heat to pass from the devices requiring cooling to the surrounding water (or air). Passive thermal conduction and/or natural convection or pumped water-cooled system (or a combination of these methods) can be used to maintain the batteries, motor, and (power and control) electronics (and all other components inside the KDA) within acceptable limits. Fins to increase heat transfer surface area can be optionally added to the exterior or interior of the KDA to further increase the convection surface area with the interior gas and the exterior surrounding water. The external fins can also be used to allow improved convective heat transfer from the external surface of the KDA which can be especially useful for applications where the boat needs to have the batteries recharged when the boat is out of the water and on a trailer for example.

The gas contained inside the hermetically sealed KDA can be pressurized to increase the gas density and improve the internal heat transfer rate (among other benefits associated with pressurizing the gas). This gas can circulate by natural convection, (or supplemented by an internal fan) so as to carry heat from the devices generating heat to an internally finned surface (or plain surface) of the interior of the KDA, to allow convection heat transfer to move the heat generated from the devices to the internal-side of the skin of the KDA and then into the surrounding water (or into the surrounding air when the boat is on a trailer).

While the gas contained inside the KDA that is used for the convection cooling could be air, alternatively it could be a stable oxygen free or inert gas to avoid the potential for fire, since an oxygen source would be eliminated from the hermetic enclosure by using such a gas instead of air. For a preferred embodiment of this invention, a combination of internal natural convection from the internal spaces in the KDA to the exterior skin of the KDA and thermal conduction between the battery's mid-plane to the skin of the KDA is the preferred embodiment with nitrogen as the inert gas. Other gasses such as argon or refrigerants could be used. Dielectric liquids could also be used. For our preferred embodiment the entire internal void space of the KDA is pressurized with nitrogen. The increased gas density due to pressurization, will improve the heat transfer to the skin of the KDA and thus improve heat rejection to the surrounding water. The nitrogen will also suppress any potential for fire, since no oxygen is present and finally, a drop in pressure can be used to signal a leak, which would be used as a signal to initiate a system shut down.

The internal volume of the KDA could be pressurized to some pressure above atmospheric pressure and monitored by the control electronics in the KDA, so that should the pressure drop, indicating a leak, the entire KDA propulsion and regeneration system could be shut down, to avoid a catastrophic failure. Likewise, a dramatic increase in the gas pressure inside the KDA could also be used as an indicator of an issue such a dramatic thermal run-a-way and cause to shut the system down.

It is also contemplated within the scope of this invention to use a dielectric liquid fluid, inert liquid fluid, or oil instead of a gas or a combination of a fluid and pressurized gas so that a problem with the system (and system shut down) could still be indicated by a change in pressure. A two-phase mixture of saturated dielectric liquid and vapor, such as a saturated refrigerant could also be used. A liquid in the KDA space would of course have improved heat transfer and thermal control, when compared to using a gas in the KDA space due to the greater density and heat capacity of the liquid verses a gas.

To improved low-speed propeller performance, increase safety, and further the invention of a unitary drive system, the one or more propeller drive assemblies are located within individual tunnel assemblies of the KDA. Water flows thru this tunnel and is accelerated by the motion of the propeller. For the slow boat speeds (under 15 knots boat speed) characteristic of most displacement hull boat operations, this shrouded propeller design will improve performance both in propulsion mode and in recharging mode. A separate rudder assembly could be located in the discharge flow path of these propellers either incorporated into the tunnel or located downstream from the KDA and fastened directly to the vessel and not part of the KDA. Of course an impeller, rather than a propeller could also be used.

The disclosure is directed to a regenerative KDA system for a vessel, for example a sailboat or power boat. It is also understood that to lower cost of the system, the regenerative battery recharging via the motion of water past the propellers of the KDA may not be economically viable for motorboat applications due to the limited use of this feature.

In one implementation, the electric drive system completely encapsulated inside a KDA, wherein the hermetically sealed KDA containing all the regenerative electric drive system components are inaccessible while the KDA is attached to the boat. The KDA contains a tunnel propeller propulsion system; optional thrusters (or rudder-like flow diverters) for stability control and maneuvering; battery storage; power electronics; control electronics; internal heat transfer fins; and external heat transfer fins. While communication between the helm of the vessel and the KDA could be via AC or DC low voltage connections, blue tooth, WiFi or other well-known wireless communication means, one or more inductive couples could also be used to transfer control communications and auxiliary housekeeping power from the hermetically sealed KDA and the boat. The inductive couple being formed by a coil in the top section of the KDA and a similar coil in the bilge of the boat, in close proximity to the coil in the KDA.

In one implementation, the KDA is characterized by having the internal cavity of the KDA pressurized with an oxygen free gas.

In one implementation, the KDA is characterized by having a change in pressure of the oxygen free gas is used to determine a problem and initiate shut down.

In one implementation, the KDA is characterized by having the oxygen free gas selected from the group consisting of nitrogen, argon, superheated refrigerant.

In one implementation, the KDA is characterized by having the oxygen free gas increased in either pressure or density, so that heat transfer to the skin of the KDA is improved.

In one implementation, the KDA has one or more fusible plugs or burst disks which will allow water to enter the KDA enclosure if a predetermined temperature or internal pressure is reached.

In one implementation, the KDA is characterized by the KDA being mounted to the bottom of the boat with quick release fasteners. In one implementation, the quick release fasteners could be characterized as thermal fracturing bolts or explosive bolts.

In one implementation, the KDA is characterized by further including a first inductive coupling for command and control communications between the boat and the components in the KDA.

In one implementation, the KDA is characterized by a second inductive coupling for power extraction for other loads in the boat.

The KDA is a hermetically sealed enclosure with all high-voltage propulsion and energy storage components contained within and the hollow void surrounding these components pressurized with an oxygen free gas or pressurized with a non-electrically conducting fluid, or a mixture of one of more of these gases and liquids.

The KDA is a hermetically sealed enclosure with all high-voltage propulsion and energy storage components contained within and there is no access to the internal components of the KDA when the KDA is mounted to the boat with an access opening that is only exposed when the KDA is removed from the boat.

Since the KDA is hermetically enclosed, the voltage within the KDA could be well above 150 volts, most likely in the 600-to-900-volt range or even higher, to reduce current carrying requirements, thereby reducing the size of cables, motors and the like. In addition, a mechanism could be employed to jettison the KDA if there were a catastrophic issue with any components in the KDA. This could be accomplished by using a thermally fracturing or exploding bolts, for example. Such a thermally fracturing bolt could have a hollow core of liquid material, that when heated dramatically increases the internal pressure, causing the bolt to rupture and the KDA to be disconnected from the hull.

The KDA is characterized by having all the necessary electric drive and regenerative energy capture components including but not limited to battery, motor, power electronics, control electronics, traverse and lateral propeller-driven propulsion system in the cavity of the hollow KDA.

In one implementation, addition to the propeller drive assembly and drive tunnel which can run the length of the KDA, there can also be thrusters. These thrusters could be conventional individual motor-driven electrically powered thrusters or means to divert some or all of the propulsion water flow in the drive tunnel to exit laterally from the KDA. These thrusters could be located fore and aft on the KDA. These thrusters develop a thrust that is transverse to the length of the KDA, and are also integrated into the KDA to allow more precise maneuvering as well as to provide additional righting moment when installed on a sailboat and sailing. The wind force on the sails causes a sailboat to heel. Resistance to heeling, called righting moment, results from the lateral movement of the boat's center of buoyancy away from the center of gravity (CG). The transverse thrust of the KDA thrusters can be used to augment the righting moment caused by the natural size and weight of a conventional keel.

In one implementation, the hollow KDA is characterized by the void inside the hollow KDA being filled with a gas that is pressurized to a pressure above atmospheric pressure, and the gas is pressurized between 5 psig and 200 psig, and the gas is an oxygen free gas that can be characterized as being selected from nitrogen, argon, and a superheated refrigerant.

In one implementation, the hollow KDA is characterized by the void inside the hollow KDA being filled with a liquid that is pressurized to a pressure at or above atmospheric pressure, and where that pressure is within the range of 0 psig to 200 psig, and the fluid is characterized by being selected from an oil, subcooled refrigerant, and a dielectric fluid.

In one implementation, the hollow KDA is characterized by the void inside being a gas and liquid mixture and where the mixture is pressurized above atmospheric pressure and pressurized within the range of 5 psig to 200 psig where the gas is selected from nitrogen, argon, and a superheated refrigerant and the liquid is selected from oil, refrigerant, and a dielectric fluid.

In one implementation, the hollow KDA is characterized by the void inside being a saturated vapor/liquid mixture and where the fluid is pressurized above atmospheric pressure and pressurized within the range of 5 psig to 200 psig where the fluid is a two-phase dielectric fluid, such as a saturated two-phase refrigerant.

In one implementation, the batteries and/or other heat generating components are mounted to a thermally conductive structure to allow heat to be transferred between the battery and the outer skin of the KDA and then to the water surrounding the KDA when in use.

In one implementation, the heat generating components inside the KDA are cooled by natural convection of the gas or liquid contained inside the KDA, thereby transferring heat between these components and the inner skin of the KDA and then to the water surrounding the KDA when in use.

In one implementation, the heat generating components inside the KDA are cooled by natural convection of a pressurized gas contained inside the KDA, whereby the increase gas pressure, increases the density of the gas and thus increases the heat transfer between the heat generating components and the inner skin of the KDA and then to the water surrounding the KDA when in use.

In one implementation, a mechanism could be employed to flood the KDA with the surrounding water, if there were a catastrophic issue with any components in the KDA. This could be accomplished by using an electrically activated solenoid valve, a thermally fracturing disk, or a pressure-bursting disk for example.

In one implementation, the command-and-control communication between the boat and the hermetically sealed KDA can be via a hard-wired low-voltage communications bus, or wireless via a known communication means or by inductive coupling where an inductive coil is located in the KDA and another inside the hull of the boat, in close proximity to the coil in the KDA. Likewise, electrical power for convenience appliances, lights, refrigeration, air conditioning, and navigational instruments can be drawn from the KDA's via a hard-wired water-tight connection or by inductive coupling where an inductive coil is located in the KDA and another inside the hull of the boat, in close proximity to the coil in the KDA. In the preferred embodiment, there are no connections between the KDA and the boat, instead inductive coupling or wireless communication is used for communication and in addition electrical power for lighting, navigational equipment and other power requirement of the vessel could be obtained by an inductive couple formed by a coil in the KDA and another in the base of the hull in close proximity to the KDA.

In one implementation, for a power boat application, especially a smaller power boat that may be directed to run up on the shore, it would be extremely desirable to have a smooth underbody (skid-plate type capability) allowing the boat to partially slide up onto and down from the shore without damage. This means ideally there are no abrupt protrusions from the hull. Since the propeller drive unit is located within a drive tunnel, the removal of the rudder from the underbody and locating the rudder at the end of the drive tunnel (or partially within the end of the drive tunnel) as well as optionally incorporating lateral openings in the drive tunnel will allow water accelerated by the propeller to be direct either out of the stern end of the KDA or laterally out the sides of the KDA for maneuvering.

The previously described implementations within of the present disclosure have many advantages including the hermitically sealed compartment that allows for high buss voltages without fear of operator or untrained service technician electrocution, since the internal electrical components of the KDA are accessible only when the KDA is removed (unbolted) from the hull.

The previously described implementations within of the present disclosure have many advantages including the use of pressure and temperature sensors within the hermetic enclosure to identity problems, The previously described implementations within of the present disclosure have many advantages including the ability to provide improved serviceably and safety since the entire propulsion system and power management system is contained in a single unitary water-tight structure, that is simply appended to the boat hull and inaccessible when the boat is located in the water.

The previously described implementations within of the present disclosure have many advantages including the use of one of more inductive coils between the hermitically sealed KDA and the hull of the vessel, eliminating the need for any power or fluid connections between the boat and the KDA, which simplifies boat construction, KDA mounting and removal and KDA repair. For example, the KDA assembly can be swapped out at the marina and shipped back to the manufacturer for refurbishment.

It is also to be understood, that while we have discussed the sailboat and power boat implementations where the KDA is bolted to the underside of the hull of the boat, it is to be understood, that the same type of hermetically sealed KDA could be used in a lifting or swing keel configuration.

It is also to be understood that if a swing or lifting keel configuration is to be used, the lifting mechanism, can also be incorporated within the KDA assembly. For example, if a hydraulically lifting or swing keel is to be used, the hydraulic system can be located within the KDA, and powered from the batteries of the KDA, and controlled by the control system of the KDA, wherein the hermetically sealed KDA lifts or swings into a pocket (or receiver) housing that accepts the KDA and is packaged with the KDA. The mounting fasteners for the system being located on the exterior of the KDA receiving housing as shown in FIG. 3.

It is also to be understood, that while we have discussed the sailboat implementation where the KDA is configured as a fin keel type configuration bolted to the underside of the hull of the boat, it is to be understood, that other keel configurations, included but not limited to Shoal keel types, Winged keel types, Skeg keel types, full keel type, lifting foil types and design variations of all these types are still possible with the proposed invention.

It is also to be understood, that while we have discussed the motor boat implementation where the KDA is configured as a deep-vee keel type configuration bolted to the underside of the hull of the boat, it is to be understood, that other keel configurations, included but not limited to shallow-vee, flat-bottom, lifting foil types and design variations of all these types are still possible with the proposed invention.

BRIEF DESCRIPTION OF THE DRAWINGS

These and other features, aspects, and advantages of the disclosure will become better understood given the following description, appended claims, and accompanying drawings where:

DESCRIPTION

In the Summary above and the Description, and the claims below, and in the accompany drawings, reference is made to particular features (including method steps) of the invention. It is to be understood that the disclosure of the invention in this specification includes all possible combinations of such particular features. For example, where a particular aspect or embodiment of the invention, or a particular claim, that feature can also be used, to the extent possible, in combination with and/or in the context of the other particular aspects and embodiments of the invention, and in the invention generally.

Figure 1:
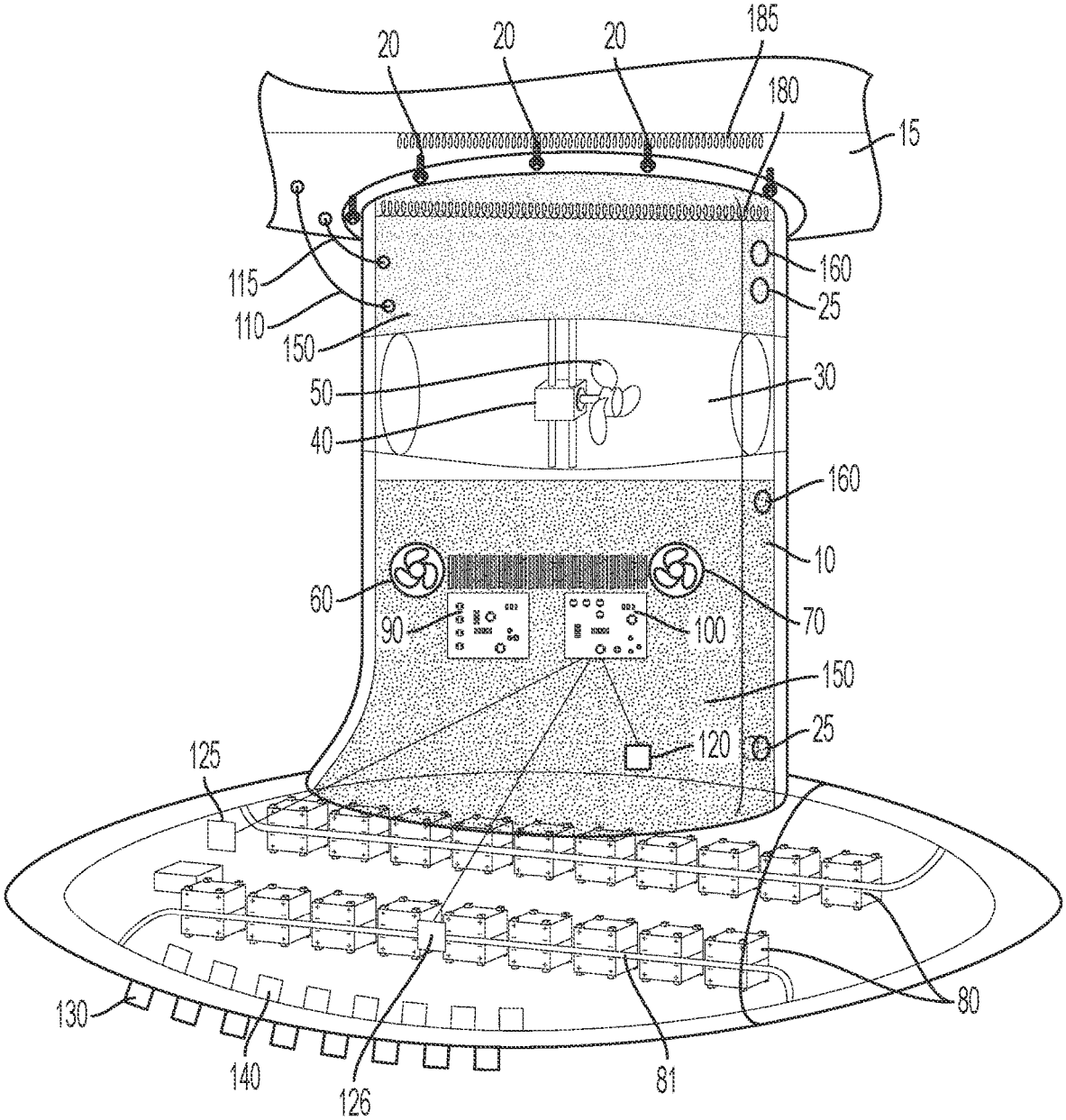
FIG. 1 shows an isometric rendering of many of the possible components of a deep-draft KDA bolted to the bottom of a boat, most likely a sailboat.

Now referring to the FIG. 1, in one implementation, the KDA 10 for a boat is connected to the bottom of the boat 15 with mounting bolts 20. Bolts 20 can be of the type that are standard fasteners that can resist the corrosive effects of water or quick release fasteners. If the bolts 20 are of the quick release fastener type, then in one implementation the fasteners can be thermal fracturing bolts or explosive bolts. Such bolts provide an advantage of in case of fire within the KDA, the KDA can be jettison from the boat and thus prevent the fire from entering into the boat. As stated earlier, as an alternative to jettisoning the KDA, burst disks 25 (or the like, such as fusible plug or electrically activated solenoid valve) on the KDA could be used to allow the surrounding water to enter the void space inside the KDA and flood the KDA.

In one implementation, communication cable 110 can be passed through the hull of the boat 15 and the KDA 10. Likewise in one implementation, a power line cable 115 can be passed between the hull of the boat 15 and the KDA 10.

In one implementation, the KDA 10 has a drive tunnel 30 located between the top and bottom of the KDA. The drive tunnel 30 contains the motor/generator 40 and propeller 50. When water current is flowing through the drive tunnel 30 the propeller 50 rotates and that rotation cause the motor/generator 40 to generate electricity which can be used to both charge the batteries 80 and provide electrical power to the boat. When the operator of the boat wishes to propel the boat, the operator can switch the motor/generator 40 into motor operation and propel the boat forward under battery power.

In one implementation, to further assist in maneuvering the boat, the KDA 10 contains a forward thruster 60 and an aft thruster 70. Forward side-thrusters 60 and aft side thrusters (one on each side) 70 that are powered by the batteries 80.

In one implementation, the KSA 10 positions the batteries 80 at the bottom of the KDA. Positioning the batteries at the bottom provides stability to the boat and lowers the center of gravity of the boat. A thermal communication path or cold plate 81, sandwiched between the batteries 80 and thermally attached to the inside skin of the KDA10 and can be used to maintain the battery temperature at or around the temperature of the water surrounding the vessel. If direct mechanical attachment to the interior surface of the KDA is not practical, a thermal connector, comprised of a thermal strap, heat pipe, liquid loop or other heat transfer means can be used to transfer heat between the battery and the water surrounding the KDA, by conducting heat between the devices or their cold plates and the interior skin of the KDA. The external skin of the KDA 10 is used to provide heat transfer between the KDA and the water surrounding the KDA. It is of course also understood that the external surface of the KDA can be finned 130 to increase heat transfer between the external surface of the KDA and the surrounding water. For a smaller boat that can potentially be trailered on land and recharged when on the trailer, the external heat transfer fins on the KDA can be used to enhance heat transfer between the KDA and the air surrounding the KDA, when the boat is being recharged on a trailer.

The void inside the KDA can also be filled with a conducting fluid, saturated fluid, or liquid vapor mixture to convectively and conductively transfer heat between the surrounding water and the contents of the KDA, including the batteries, electronics, motors, and the like. In the preferred embodiment a combination of these methods are used with cold plate cooling for the batteries and conduction and convection cooling for the remaining components inside the KDA. A fan (or pump not shown), can be used to circulate the fluid contained inside the KDA to increase the convective heat transfer, that is to achieve forced convection heat transfer.

The KDA 10 contains power electronics 90. Power electronics 90 regulate the power between the batteries 80 and the motor/generator 40. Inductive transformer coil 180 in the KDA 10 and another inductive coil 185 inside the boat hull 15 can be used to transfer two-way electrical power between the regenerative keel drive assembly 10 and the boat instead of or in addition to using the power cable 115. When KDA 10 is in regenerative mode, power electronics 90 distributes power from the motor/generator 40 to the batteries 80 to charge the batteries 80. When the operator decides to propel the boat, the power electronics 90 distributes power from the batteries 80 to the motor/generator 40 in order to rotate the propeller 50. The inductive coil pair 180 and 185 is also used to recharge the batteries when the boat is at the dock and connected to shore power and used to supply power to the accessories in the boat by drawing power from the batteries 80 of the KDA 10.

The rudder of the boat can be cantilevered off the aft end of the KDA, located at the trailing end of the drive tunnel, or attached to the boat and not attached to the KDA. The rudder used in the FIG. 1 configuration would be attached to the downstream end of the boat and is not shown.

The KDA 10 contains control electronics 100. Control electronics 100 are designed to transfer two-way command and control information between the boat to the KDA 10 through the communications cable 110, a second pair of inductive coils not shown, or the inductive transformer coils 180 and 185 used to transfer electrical power can also be used to transfer command and control instructions as well as power by using the power-line transmission method. Command and control communications maintain and report the battery state of charge, respond to navigational and propulsion commands from the boat, monitor for adverse problems with the drive system, monitor internal temperature and internal KDA gas pressure, and check for excessive power draw, voltage anomalies, and current anomalies. Control commands include, but are not limited to, engaging regenerative mode, propulsion mode, maneuvering mode. It is of course understood, that other means of wireless communication, including radio and Bluetooth communication between the vessel and the hermetically sealed KDA could be used to transmit control and status information between the operator in the vessel and the devices inside the KDA that react to the stated commands.

The KDA contains a pressurized fluid 150 that completely fills all void spaces inside the KDA 10. Pressure transducer 120 is used to measure the pressure of the fluid within the KDA 10. Any change in pressure is sensed by the pressure transducer 120. If the pressure is changed to a point that such a change signals a problem with the KDA 10, then shut down of the system can be initiated. Temperature transducer 125 is used to measure the temperature of the fluid within the KDA 10 and/or temperature transducer 126 is used to measure the temperature of the batteries or battery cold plate. Any change in temperature is sensed by the temperature transducer 126 mounted to the cold plate 81 or temperature transducer 125 immersed in the fluid contained in the KDA. If the temperature is changed to a point that such a change signals a problem with the KDA 10, then shut down of the system can be initiated. If a saturated fluid is used within the KDA, then the temperature of the saturated fluid could be determined by the pressure transducer in the system, so a pressure transducer could be used for both pressure and temperature monitoring.

The fill port 160 is used to fill the internal structure of the KDA with the pressurized gas or liquid or mixture of gas and liquid. The location of the fill port is not critical so long as the internal structure can be filled appropriately, in the preferred embodiment, even when the KDA is attached to the hull of the vessel.

In one implementation, KDA 10 contains internal heat transfer fins 140. The fins 140 facilitate convective heat transfer between the fluid contained in the internal portion of the KDA to the internal side of the skin of the KDA and then via conduction through the skin to the external surface of the KDA and then into the surrounding water.

If servicing the KDA 10 is desired, then a removable access port or cover (not shown) is provided to permit access to the internal components only when the boat is out of the water, the KDA is detached from the boat and the cover is then exposed.

Figure 2:
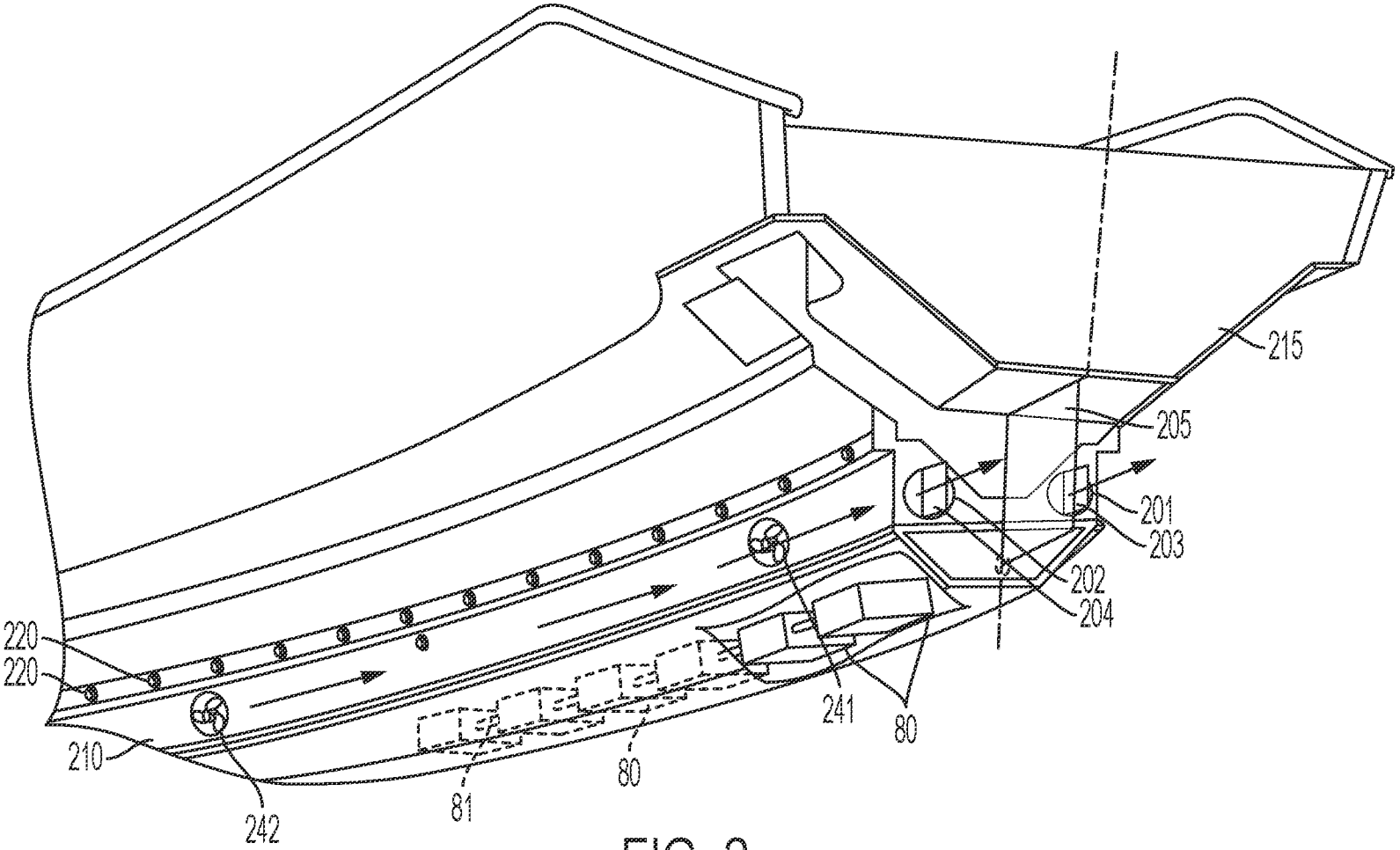
FIG. 2 shows an isometric rendering of a low-draft version of the KDA mounted to the bottom of a boat, most likely a power boat.

Similar to the sailboat application, the KDA can also be fitted to a power boat and configured in a similar manner, FIG. 2. For example, the KDA can span a portion or run the entire length of the bottom of the vessel and there can also be thrusters located fore and aft on the KDA. Since the rigid KDA in the power boat application would typically be of similar length or longer but also much wider and far less deep, two drive tunnels 201, 202 would be a preferred configuration with individual rudders 203 and 204 located at the rear most end of the drive tunnels or a single rudder aft of the KDA but in the propellor's outwash could be used, and this single rudder could be attached to the KDA (not shown) or instead attached to the hull of the boat 205. Attaching the rudder 205 and therefore control of the rudder on the boat hull instead of on the KDA, simplifies the design of the KDA, and simplifies the propulsion control of the KDA. The lack of protrusions on the underside, allow the KDA to also function as a skid-plate and allow a portion of the boat to slide up and down on the shore, simplifying beach access (and trailer mounting) without damage to the typical fiberglass (softer and less resilient) hull of a conventional motor boat.

Referring to the FIG. 2, and like the sailboat application, in one implementation, the KDA 210 for the power boat application is once again connected to the bottom of a power boat hull 215 with mounting bolts 220. Bolts 220 can be of the type that are standard fasteners that can resist the corrosive effects of water or quick release fasteners. Alternatively burst disks can still be employed in this application to flood the KDA if serious fires or other issues occur.

In the FIG. 2 implementation of the KDA, a Vee Configured keel 210 has a two drive tunnels 201 and 202. Each drive tunnel contains a motor/generator and propeller that are not shown. When water current is flowing through the drive tunnels the propellers rotate and that rotation causes the motors/generators to generate electricity which can be used to both charge the batteries 80 and provide electrical power to the boat. When the operator of the boat wishes to propel the boat, the operator can switch the motor/generator into motor operation and propel the boat forward under battery power.

In one implementation, to further assist in maneuvering the boat, the KDA 210 contains a forward thruster 242 and an aft thruster 241 powered by batteries 80 within the KDA.

In one implementation, the KDA 210 positions the batteries 80 at the bottom of the KDA. Positioning the batteries at the bottom provides stability to KDA and thus the boat attached to the KDA. Thermal communication paths or cold plates 81, sandwiched between the batteries 80 can be used to maintain the battery temperature at or around the temperature of the water surrounding the vessel. The void inside the KDA can also be filled with a conducting fluid, saturated vapor, or liquid vapor mixture to convectively and conductively transfer heat between the surrounding water and the contents of the KDA, including the batteries, electronics, motors and the like. In the preferred embodiment a combination of these methods are used with cold plate cooling for the batteries and conduction and convection cooling for the remaining components inside the KDA. A fan or pump (not shown) can be used to circulate the fluid contained inside the KDA to increase the convective heat transfer, that is to achieve forced convection heat transfer.

The KDA 210 for the motor boat, like the sailboat, contains power electronics and control electronics located inside the KDA (not shown). Power electronics regulate the power between the batteries 80, the one or more motor/generators and the one or more inductive transformer coils.

The FIG. 2 KDA design in only one preferred power boat KDA configuration anticipated by the proposed invention, where the KDA 210 has more of a "Vee Stepped Configuration" typical of many planing power boats. Naval Architects well versed in the art could utilize any number of typical hull shapes, from various stepped and un-stepped vee configurations, to more flat bottom designs. Lifting foils could also be incorporated into the KDA design shape.

Figure 3:
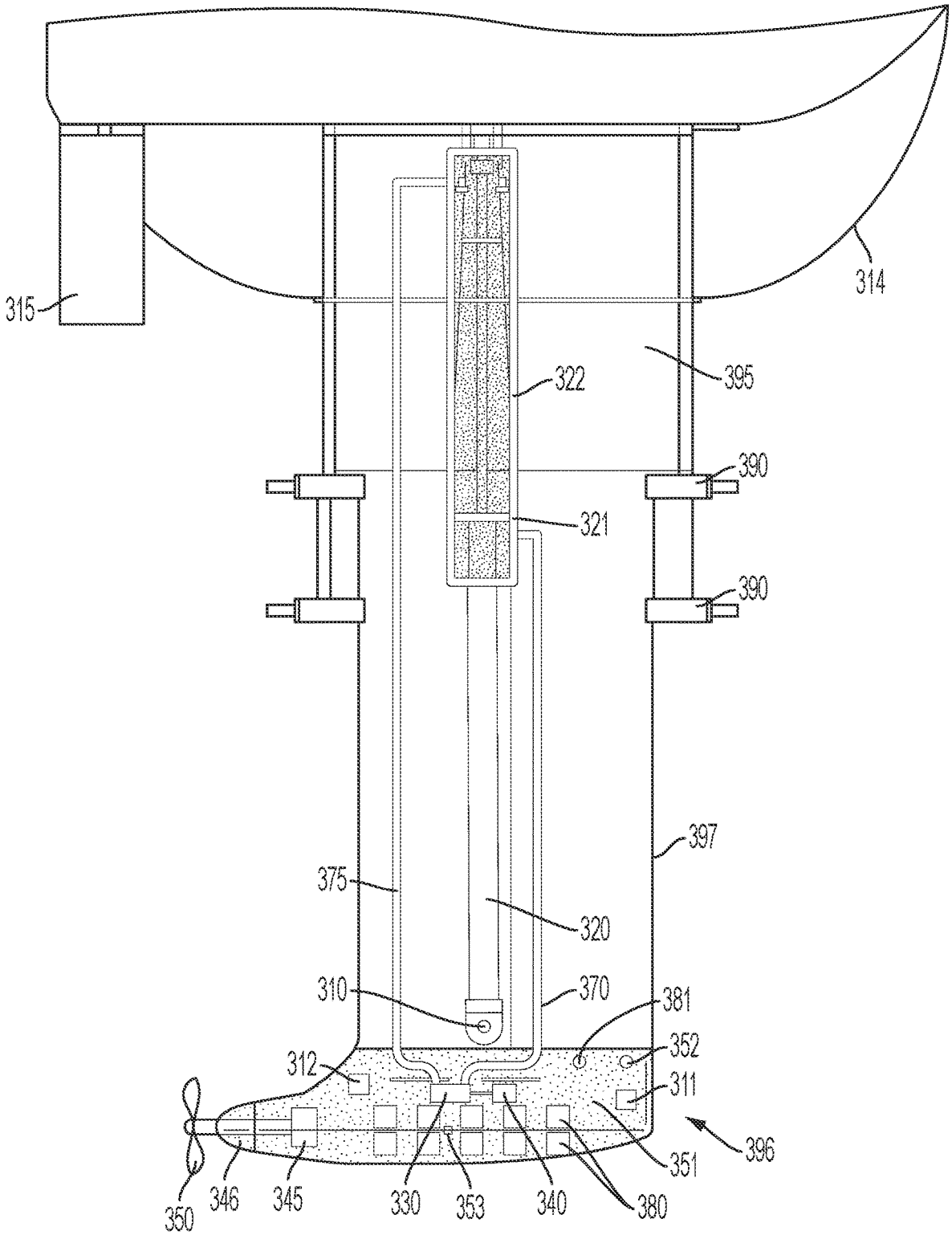
FIG. 3 shows an isometric view of a lifting-keel version of the KDA mounted to the bottom of a boat, most likely a sailboat.

FIG. 3 shows one embodiment of a conventional type of lifting keel design, connected to the bottom hull well known in the art where a hydraulic ram 320 lifts the keel up and down. The bulb or base of the typical keel 396 is attached to a narrow foil shaped protrusion 397 which moves up and down by the action of the hydraulic ram 320 and is guided by multiple glide blocks or linear bearings 390, and rides inside a pocket 395 which can be totally inside or outside of the hull 314, or contained partially inside and partially outside the hull 314 as shown in FIG. 3. In one embodiment of my design of the KDA, the hydraulic pump 330 and hydraulic electric motor 340 that powers the hydraulic pump and all the associated power electronics 311 and control electronics 312 are packaged inside the base of the keel 396 and forms the KDA. This base, which is the hermetically sealed KDA, 396 lifts up (or swings-up not shown) into the pocket 395 of the boat's hull 314. Hydraulic supply (keel up) 370 and return (keel down) 375 lines provide the hydraulic power to actuate the hydraulic piston 321 which is inside the overall hydraulic piston assembly 322, to cause the ram 320 to recede into or extend outward from the hydraulic assembly 322. When hydraulic pressure is supplied to the bottom of the piston 321 by hydraulic line 370 and hydraulic fluid returns to the hydraulic pump 330 via hydraulic line 375 the ram 320 recedes into the hydraulic piston assembly and the keel is lifted. When hydraulic pressure is supplied to the top of the piston 321 by hydraulic line 375 and hydraulic fluid returns to the hydraulic pump 330 via hydraulic line 370 the ram 320 extends from the hydraulic piston assembly and the keel is lowered. The KDA 396 contains power electronics 311. Power electronics 311 regulate the power between the batteries 380, the hydraulic pump motor 340 and the motor/generator 345 which rotates the propeller 350 via motor shaft 346. When KDA 396 is in regenerative mode, power generated by spinning the propeller is managed by the power electronics electronics 311 which then distributes power to the batteries 380 to charge the batteries 380. When the operator decides to propel the boat, the power electronics 311 distributes power from the batteries 380 to the motor/generator 345 in order to rotate the propeller 350. This FIG. 3 embodiment shows the propeller outside the KDA rather than packaged inside a drive tunnel as was shown in FIGS. 1 and 2. Either configuration is within the scope of this invention. For this type of sailboat application, the rudder 315 of the boat is cantilevered off the aft end of the sailboat hull and not part of the KDA, or any part of the keel lifting structure of FIG. 3. The KDA 396 contains control electronics 312. Control electronics 312 are designed to transfer control commands from the boat to the KDA 396, maintain and report the battery state of charge, respond to propulsion commands from the boat, respond to keel lift and drop commands from the boat, monitor for adverse problems with the drive system, monitor internal temperature and internal KDA gas pressure, and check for excessive power draw, voltage anomalies, and current anomalies. Control commands include, but are not limited to, engaging regenerative mode, and propulsion mode, and activating the hydraulic motor 340 and drive motor 345. It is of course understood, that wireless communication, including radio and Bluetooth communication between the vessel and the hermetically sealed KDA could be used to transmit control and status information between the operator in the vessel and the devices inside the KDA that react to the stated commands. The KDA contains a pressurized fluid 351. Pressure transducer 352 is used to measure the pressure of the fluid within the KDA 396. Any change in pressure is sensed by the pressure transducer 352. If the pressure is changed to a point that such a change signals a problem with the KDA 396, then shut down of the system can be initiated. Temperature transducer 353 is used to measure the temperature of the fluid within the KDA 396 and/or the temperature of the batteries or battery cold plate. Any change in temperature is sensed by the temperature transducer 353 and if the temperatures changes to a point that signals a problem, then shut down of the system can be initiated. If a saturated fluid is used within the KDA, then a temperature and pressure of the saturated fluid could be determined by either the pressure transducer or temperature sensor in the system, so a single measurement of either temperature or pressure transducer could be used for both pressure and temperature monitoring. The fill port 381 is used to fill the internal structure of the KDA with the pressurized gas or liquid or mixture of gas and liquid 351. The location of the fill port is not critical so long as the internal structure can be filled appropriately, in the preferred embodiment, even when the KDA is attached to the hull of the vessel. If servicing the KDA 396 is desired, then a removable access port or cover (not shown) preferably located under the connecting pin 310 is provided to permit access to the internal components only when the boat is out of the water, the KDA is detached from the boat by removing the connecting pin 310 and the cover is then exposed. If it was desired to jettison the KDA 396 in this configuration, the preferred option is to release connecting pin 310. As with other KDA configurations, a thermal fusible plug or burst disk could be used to automatically flood the interior of the KDA 396, should a temperature of pressure extreme be reached.

Some example calculations on the size of the battery pack for one preferred sailboat embodiment, would be useful at this time. Assuming a 34-foot sailboat with a total displacement of 14,000 pounds. To get such a boat quickly onto a plane would require about 420 horsepower (HP). Assuming a conservative specific energy of the battery pack at 74 W-hr/kg, specific power of 185 W/kg and energy density of 185 W-hr/liter and an overall conversion efficiency of 80%, then approximately 12,000 pounds of batteries would be required to provide sufficient power to get the sail boat up on a plane for about 1 hour. Alternatively, this would provide an auxiliary powered displacement boat ride of about 20 hours, with the motor producing about 20 Hp shaft power. This battery weight and the resulting overall KDA weight is appropriate for a sailboat of this size. These batteries would occupy about 71 cubic feet, so for a shallow draft design with a draft of about 4.4 feet, an average KDA width of about 2 feet and a battery to KDA volume ratio of about 80%, the KDA length would be about 10 feet. This would be a very practical keel configuration and keel weight for the proposed 34 foot sailboat.

It is also useful to note that the KDA could be of the winged keel configuration, which is well known in the art to increase the draft while sailing, without increasing the draft while motoring. Furthermore, the winged keel could provide lift, by acting as a foil when the boat is operating under high power planning conditions, thereby improving performance, reducing power consumption and extending the high-power operating time.

Some example calculations on the size of the battery pack for one preferred small motor boat embodiment, would be useful at this time. Assuming a 20-foot trailer-able motor boat with a total displacement of 6,000 pounds. To get such a boat quickly onto a plane would require about 120 horsepower (HP). Once again, assuming a conservative specific energy of the battery pack at 74 W-hr/kg, specific power of 185 W/kg and energy density of 185 W-hr/liter and an overall conversion efficiency of 80%, then approximately 10,000 pounds of batteries would be required to provide sufficient power to get the motor boat up on a plane for at least 3 hours. This would also provide a cruising time of 35 hours, with the motor producing about 10 Hp shaft power. These batteries would occupy about 64 cubic feet, so for a shallow draft design with a draft of about 1.3 feet, an average KDA width of about 6 feet and a battery to KDA volume ratio of 80%, the KDA length would be about 10 feet. This would be a very practical KDA configuration for the proposed 20-foot motor boat.

While we have shown and described several implementations in accordance with the disclosure, it should be understood that the same is susceptible to further changes and modifications without departing from the scope of the disclosure. Therefore, we do not want to be limited to the details shown and described herein but intend to cover all such changes and modifications as are encompassed by the scope of the appended claims.

What is claimed is:

1. An electric drive system for a boat that is completely encapsulated inside a hollow keel, attached to the underside of a marine vessel, wherein the keel is hermetically sealed and the electric drive system components are inaccessible while the boat is located in the water, comprising:

propeller propulsion system;

battery storage;

power electronics;

control electronics; and the hermetically sealed keel system is filled with a fluid, wherein the fluid is used to:

improve the heat transfer between the components inside the hollow keel and the water surrounding the keel, indicate any leaks in the hermetic seal, and prevent combustion inside the system.

2. The electric drive system of claim 1, where the propeller propulsion system, power electronics and control can also be used to generate power by the spinning of the propeller to provide regenerative power back into the battery system.

3. The electric drive system of claim 1, where the fluid is pressurized.

4. The electric drive system of claim 1, wherein the fluid is non-flammable.

5. The electric drive system of claim 1, wherein the fluid is an oxygen free gas.

6. The electric drive system of claim 1, wherein the fluid is a dielectric fluid.

7. The electric drive system of claim 1, wherein the fluid is composed of one or more refrigerants.

8. The electric drive system of claim 3, wherein a change in pressure inside the hermetic enclosure is used to determine a problem and initiate shut down.

9. The electric drive system of claim 1, wherein a change in temperature of the fluid is used to determine a problem and initiate shut down.

10. The electric drive system of claim 5, wherein the oxygen free gas is selected from the group consisting of nitrogen, argon, helium, and neon.

11. The electric drive system of claim 3, wherein when the internal pressurized fluid causes an increase in heat transfer cooling to the internal skin of the keel.

12. The electric drive system of claim 1, wherein the keel is mounted to the bottom of the boat with fasteners.

13. The electric drive system of claim 12 where the mounting is accomplished with releasable fasteners.

14. The electric drive system of claim 13, wherein the releasable fasteners are selected from the group consisting of thermal fracturing bolts and explosive bolts.

15. The electric drive system of claim 1, wherein the keel is mounted to receiver with one or more fasteners, in such a way to allow the keel to partially or fully retract or swing into the inside of the receiver and the receiver is then mounted to or part of the hull of the boat.

16. The drive system of claim 15 where the mounting is accomplished with releasable fasteners or a fastening pin.

17. The electric drive system of claim 16, wherein the releasable fasteners or pin are selected from the group consisting of thermal fracturing and explosive fasteners and pins.

18. The electric drive system of claim 1, further comprising:

a first inductive coupling for command-and-control communications between the boat and the components in the keel.

19. The electric drive system of claim 18, further comprising:

a second inductive coupling for power extraction, shore power battery recharging and for other loads in the sailboat.

20. The electric drive system of claim 1, where internal components in the keel are un-accessible when the keel is mounted to the boat with an access opening that is only exposed when the boat is removed from the water and the keel is removed from the boat.

21. The electric drive system of claim 1, where the interior surface of the hollow keel contains fins to increase heat transfer.

22. The electric drive system of claim 1, where the exterior surface of the hollow keel contains fins to increase heat transfer.

23. The electric drive system of claim 1, where the hollow keel contains one or more fittings to allow the hollow keel to be flooded with water when the keel is attached to the boat and the boat is in the water.

24. The electric drive system of claim 23, where the fittings consist of one or more pressure bursting or temperature bursting fittings that open when exposed to excessive temperature or pressure.

25. The electric drive system of claim 23, where the fittings consist of one or more fusible plugs that open when exposed to excessive temperature.

26. A hollow keel forming a void therein and which the keel is completely sealed and any internal components in the keel are un-accessible when the keel is mounted to the boat with an access opening that is only exposed when the boat is removed from the water, and the keel is removed from the boat; wherein the hollow keel is filled with all the necessary electric drive and regenerative energy capture components including but not limited to battery, motor, power electronics, and control electronics, and wherein the void inside the hollow keel is filled with a fluid.

27. The hollow keel of claim 26, wherein the fluid is pressurized between 0.0 psig and 200 psig.

28. The hollow keel of claim 26, wherein the fluid is an oxygen free gas.

29. The hollow keel of claim 28, wherein the oxygen free gas is selected from the group consisting of nitrogen, argon, neon, helium, and refrigerants.

30. A hollow keel forming a void therein and which the keel is completely sealed and any internal components in the keel are un-accessible when the keel is mounted to the boat with an access opening that is only exposed when the boat is removed from the water, and the keel is removed from the boat, wherein the void is filled with a dielectric liquid.

31. The hollow keel of claim 30, wherein the liquid is pressurized between 0.0 psig and 200 psig.

32. The hollow keel of claim 30, wherein the liquid is selected from the group consisting of oil, refrigerant, or other dielectric fluids.

33. A hollow keel forming a void therein and which the keel is completely sealed and any internal components in the keel are un-accessible when the keel is mounted to the boat with an access opening that is only exposed when the boat is removed from the water, and the keel is removed from the boat, wherein the void inside the keel is filled with a mixture of a liquid and a gas, wherein the mixture is pressurized to a pressure at or above atmospheric pressure.

34. The hollow keel of claim 33, wherein the mixture is pressurized between 0 psig and 200 psig; wherein the gas is selected from the group consisting of nitrogen, argon, neon, helium and refrigerant; and the liquid is selected from the group consisting of oil, refrigerant, and a dielectric fluid.

* * * * *